United States Patent [19]

Nottingham et al.

[11] Patent Number: 5,059,755

[45] Date of Patent: Oct. 22, 1991

[54] LOW PROFILE OVEN TURNTABLE

[75] Inventors: John R. Nottingham; John W. Spirk, both of Moreland Hills; Jeffrey M. Kalman, Cleveland Heights, all of Ohio

[73] Assignee: G & S Metal Products Company, Inc., Cleveland, Ohio

[21] Appl. No.: 556,670

[22] Filed: Jul. 23, 1990

[51] Int. Cl.[5] ..... H05B 6/78

[52] U.S. Cl. ..... 219/10.55 F; 219/10.55 E; 108/20; 126/338

[58] Field of Search ..... 219/10.55 F, 10.55 E; 108/20, 139, 142; 99/443 R, DIG. 14; 126/338

[56] References Cited

U.S. PATENT DOCUMENTS

| | | | |
|---|---|---|---|
| 4,219,715 | 8/1980 | Mandle et al. | 219/10.55 F |
| 4,330,696 | 5/1982 | Pomeroy et al. | 219/10.55 F |
| 4,434,343 | 2/1984 | Bowen et al. | 219/10.55 F |
| 4,523,070 | 6/1985 | Jorgensen et al. | 219/10.55 F |
| 4,629,846 | 12/1986 | Dilyard | 219/10.55 F |
| 4,636,605 | 1/1987 | Berend et al. | 219/10.55 F |
| 4,746,781 | 5/1988 | Dalquist, III et al. | 219/10.55 F |
| 4,808,781 | 2/1989 | Liu | 219/10.55 F |

*Primary Examiner*—Philip H. Leung

*Attorney, Agent, or Firm*—Pearne, Gordon, McCoy & Granger

[57] ABSTRACT

A rotatable platform having a relatively circular turntable top rotationally supported above a unitary base by a plurality of wheels which make tangential point contact with the underside of the turntable top. The base includes a raised rim portion that carries the rotationally mounted wheels. A step is formed between the raised rim portion and the remainder of the base that helps prevent food particles from contacting a gear train assembly contained within the base. A flat spiral spring is housed beneath the gear train assembly and cooperates with the gear train assembly to rotate the turntable top. A detent is provided on the base that engages an escapement blade for stopping rotation of the turntable top. The base is substantially square with rounded corners.

22 Claims, 3 Drawing Sheets

LOW PROFILE OVEN TURNTABLE

BACKGROUND OF THE INVENTION

1. Field of the Invention

This invention relates generally to turntables, and in particular to a turntable for use in a conventional oven for supporting and rotating containers in which food stuffs are placed for baking or cooking.

2. Description of the Prior Art

The advantages associated with rotating food stuffs as they bake or cook has been known in the art for a long time as indicated in U.S. Pat. No. 557,344 issued to Shaw. The Shaw patent dates back to 1896 and describes a turntable device having a spring motor for rotating the table. Because most ovens at that time were wood or coal fired the heat was not evenly distributed within the oven chamber. Rotating the food stuffs more uniformly exposed them to the infra-red energy thereby resulting in the food stuffs being more evenly cooked or baked than if they were not rotated.

The advent of natural gas and electric ranges provided interior heating elements arranged so that a relatively uniform distribution of heat throughout the oven chamber was achieved. However, due to the various designs and manufacturers of modern ranges it was discovered that the heat was not as evenly distributed as was necessary to achieve the optimum baking and cooking results. Thus, there remains a need with conventional ovens for rotating food stuffs to obtain relatively even baking and cooking results.

The advent of microwave ovens gave rise to numerous patents being granted on devices for rotating food stuffs while cooking in a microwave. The necessity of such rotatable devices is due to "hot spots" created during cooking. It was discovered that rotating the food stuffs would more evenly distribute the infra-red energy thereby cooking the food stuffs more evenly. A common design feature of all of these rotatable devices is that they are made almost entirely of plastic to prevent arcing between the device and the interior walls of the microwave oven.

The basic design of these devices includes a turntable top mounted on a stationary base. The turntable top is usually driven by a mechanical means such as that disclosed in U.S. Pat. No. 4,523,070, issued to Jorgensen et al. The turntable top of Jorgensen is supported above the stationary base at its center by a mechanical means and at its periphery by an arrangement of ball bearings. The ball bearing configuration creates a relatively large amount of surface contact between the ball bearings and the rotatable platform thereby inhibiting ease of rotation. The additional weight of food stuffs placed on the rotatable platform slightly increases the coefficient of friction between the ball bearings and the platform so that the mechanical means driving the rotatable platform must work harder. The friction created by the ball bearings may shorten the life expectancy of the oven turntable, or lead to repair or replacement of the mechanical components, relative to a design that minimizes the surface contact between the rotatable platform and the means for supporting it above the base. U.S. Pat. Nos. 4,625,087 and 4,523,070, issued to Jorgensen et al., both disclose ball bearing methods for supporting the rotatable platform above the base, as does U.S. Pat. No. 4,746,781, issued to Dalquist, III et al.

Another oven turntable is disclosed in U.S. Pat. No. 4,808,781, issued to Liu. The turntable of Liu utilizes three flat-surfaced wheels mounted on axles to support the turntable top above the base. Again, the flat surface contact between the wheel and the turntable top creates friction that impedes the rotation of the top, especially when it is rotating relatively heavy containers.

The majority of oven turntables used for rotating food stuffs within a microwave oven are circular so they can snugly fit into the confines of the microwave. One disadvantage of this shape is that it is difficult to firmly grasp the edge of the turntable and remove it from an oven. The perimeter of a circular base does not provide enough linear edge space to adequately grasp the turntable and maintain its balance when taking it out of or placing it into the oven.

It is a desirable feature of any oven turntable to include a means for stopping its rotation when desired. U.S. Pat. No. 4,746,781, issued to Dalquist, III et al., describes such a mechanism. The locking member of Dalquist is pivotally mounted and thus prone to possible breakage because of the lateral forces exerted on the locking member when it engages a notch on the turntable wall. Also, that portion of the locking member used to activate it is located substantially underneath the turntable or base in a relatively inaccessible position that prevents ease of operation.

U.S. Pat. No. 4,808,781, issued to Liu, describes a similar device for halting the rotation of a turntable top. The Liu device is pivotally mounted and susceptible to wear and tear and possible shearing of the mounting pin resulting from lateral forces exerted thereon when it is lockingly engaged. Also, the positioning of the break arm inhibits ease of manipulation by the user.

The aforementioned patents all relate to oven turntables that are used with microwave ovens, and have their primary components made of plastics that are not capable of being used in a conventional oven.

Other concerns associated with oven turntables used in conventional ovens are: 1) keeping the production costs down; 2) maintaining a simple design for easy use and repair; 3) taking up minimal space in the oven; 4) having the oven turntable last as long as possible; and 5) using suitable materials to withstand the high temperatures.

SUMMARY OF THE INVENTION

The preferred embodiment of the present invention combines a variety of features that achieve simplistic construction, ease of operation, a low profile, and durability. The overall characteristics of the present invention provide an improved oven turntable for use in conventional ovens.

One feature of the preferred embodiment of the present invention is a unitary base stamped from an appropriate sheet metal that is capable of withstanding the temperatures of a conventional oven. Stamping the base helps keep the production costs down. The unitary base forms part of a spring housing, and is configured to house a gear train assembly in a low profile manner thereby occupying a minimum amount of space in the oven. Another feature of the base is that it forms a circumferential step-up that helps prevent food stuffs from contacting the spring or gear train assembly. The step up forms a circumferential rim that carries several support wheels for supporting a turntable top. The base also features an internal bead along its bottom edge that inhibits the accumulation of food stuffs along the bottom perimeter of the base. The internal bead also helps prevent the user's fingers from being scratched or cut when placing the oven turntable into or removing it from a conventional oven.

Another feature of the base is that its perimeter is substantially square so it can be grabbed easily with mitts or hot pads. The square base allows the oven turntable to be relatively easily balanced, especially when containers are placed on the turntable top. The square base provides an advantage over its circular predecessors, which were more difficult to balance.

The stationary base rotationally supports a turntable top upon which food stuffs are set during baking or cooking. Another feature of the preferred embodiment is that the turntable top is supported at various points along its underside by the rotatably mounted support wheels. The support wheels make tangential point contact with the underside of the turntable top that create a relatively small amount of friction. This allows the turntable top to rotate relatively freely thereby possibly extending the life expectancy of the mechanical components.

Furthermore, the rotation of the turntable top causes the air in the oven to stir slightly resulting in more even baking and tending to remove dead air space. This movement creates a slight convection effect causing the oven to cycle less.

The turntable top is rotated by a gear train assembly that is responsive to a wound spring. The rotation of the turntable top creates a slight vibration caused by escapement and the contact between the support wheels and the underside of the turntable top. The vibration causes a settling of some baking constituents resulting in a reduction of air bubbles within those baked goods. This helps achieve superior baking and cooking results.

Another feature of the preferred embodiment is that once the turntable top is rotating it can be stopped selectively by the user. This feature is carried out by an on/off detent slidably mounted on the stationary base and located where it is easily manipulated by the user. The detent has an easily accessible handle for sliding the detent between an engaged and disengaged position. The stationary base has two grooves adapted to receive a tongue connected to the underside of the detent and retain the detent in either its engaged or disengaged position. When the detent is engaged it interrupts the gear train assembly and stops the rotation of the turntable top.

Also, still another feature of the preferred embodiment is that the noise caused by the escapement acts as a signal indicating that the motor has run down and ceased to operate. When the noise stops the user knows its time to re-set the oven turntable, if necessary. Prior oven turntables used in microwaves were primarily made of plastics having a damping effect thus substantially eliminating the noise caused by escapement.

Because the preferred embodiment is to be used in a conventional oven the component parts must be made of an appropriate composition capable of sustaining high temperatures. Thus, the gears and support wheels are made primarily of powdered metal capable of withstanding such high temperatures. The spring used to drive the turntable top is made from a high temperature stainless steel so that the oven turntable can also be used for broiling. Additionally, the remaining components are made of silicone or have a Silverstone finish for easy cleaning.

Another feature of the preferred embodiment is that the turntable top is lower at its center than at its edges. This is so containers placed thereon will make contact at their rims rather than at their centers and will consequently be held in place while the turntable top is being rotated. This concave feature of the turntable top assures that food stuff containers will not work their way off the turntable top while rotating.

The overall configuration of the oven turntable has a low profile. The low profile is employed advantageously so that when containers are placed on the turntable top they will not interfere with other racks in the oven, or get too close to the heating elements. The low profile is achieved by the one piece shape of the unitary base and the compact arrangement of the gears, spring, and spring arbor.

It has been determined that use of the oven turntable according to the present invention increases the size of cakes resulting in a more tender crumb and higher yield. It reduces shrinkage of pie crusts and other pastries; this provides flakier pastry and more uniform size and color.

DETAILED DESCRIPTION OF THE PREFERRED EMBODIMENT

Figure 1:
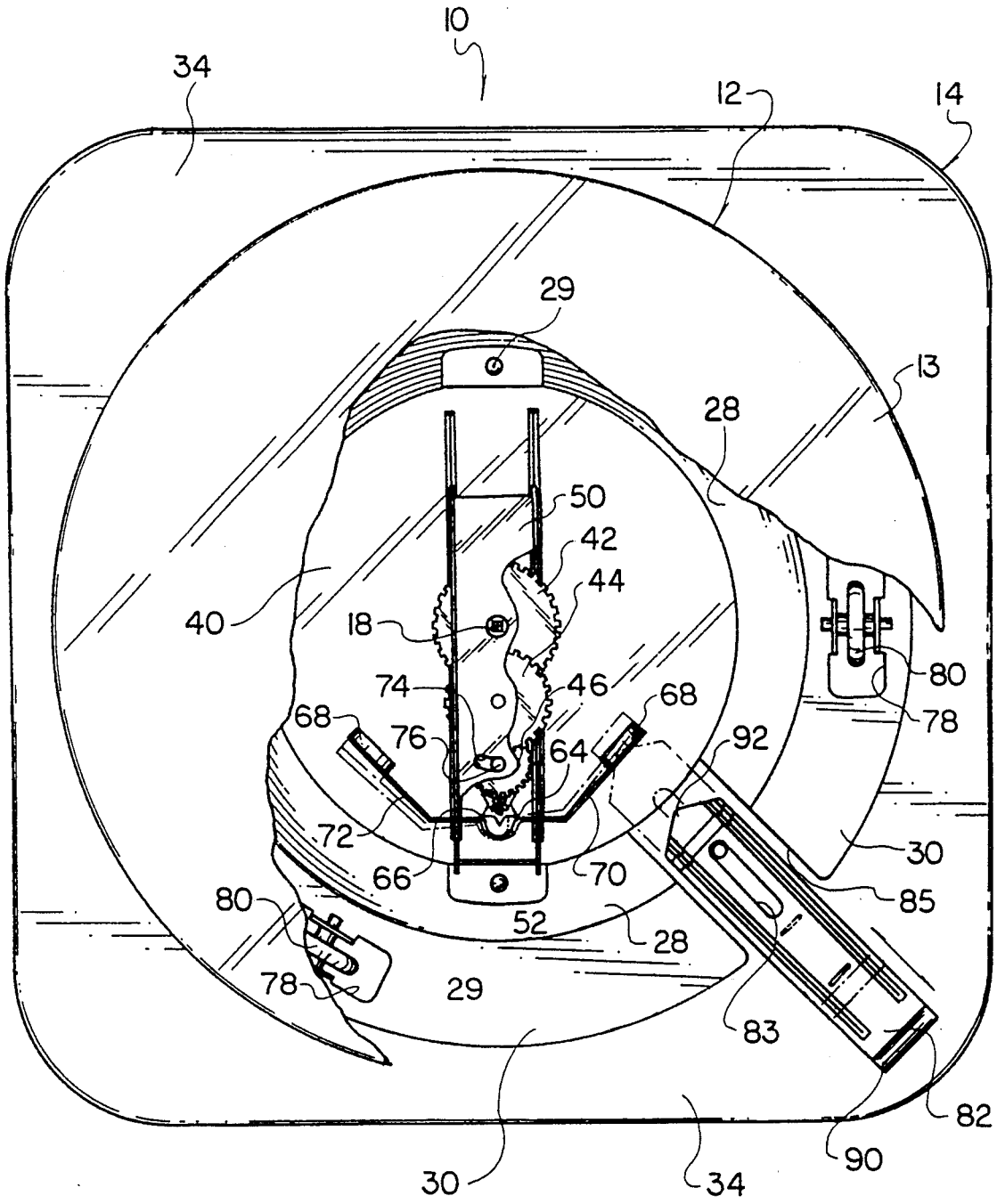
FIG. 1 is a top plan elevational view of a preferred embodiment according to the present invention with parts partially broken away to facilitate illustration of certain features.
Figure 2:
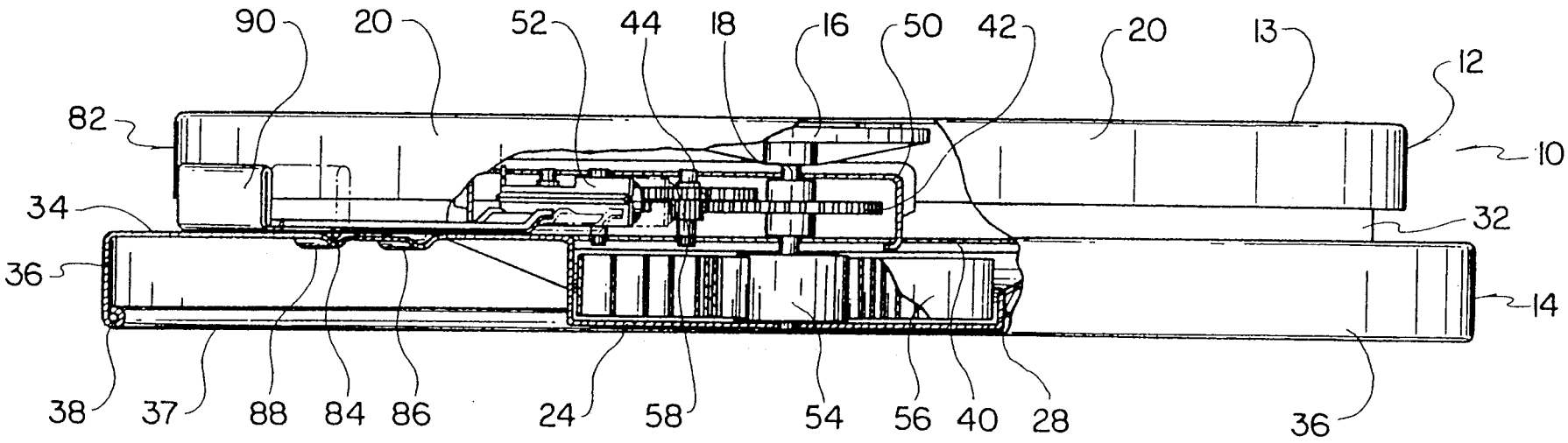
FIG. 2 is a partial cross-sectional side elevational view of the preferred embodiment of FIG. 1 with parts partially broken away to facilitate illustration of the internal construction thereof.
Figure 3:
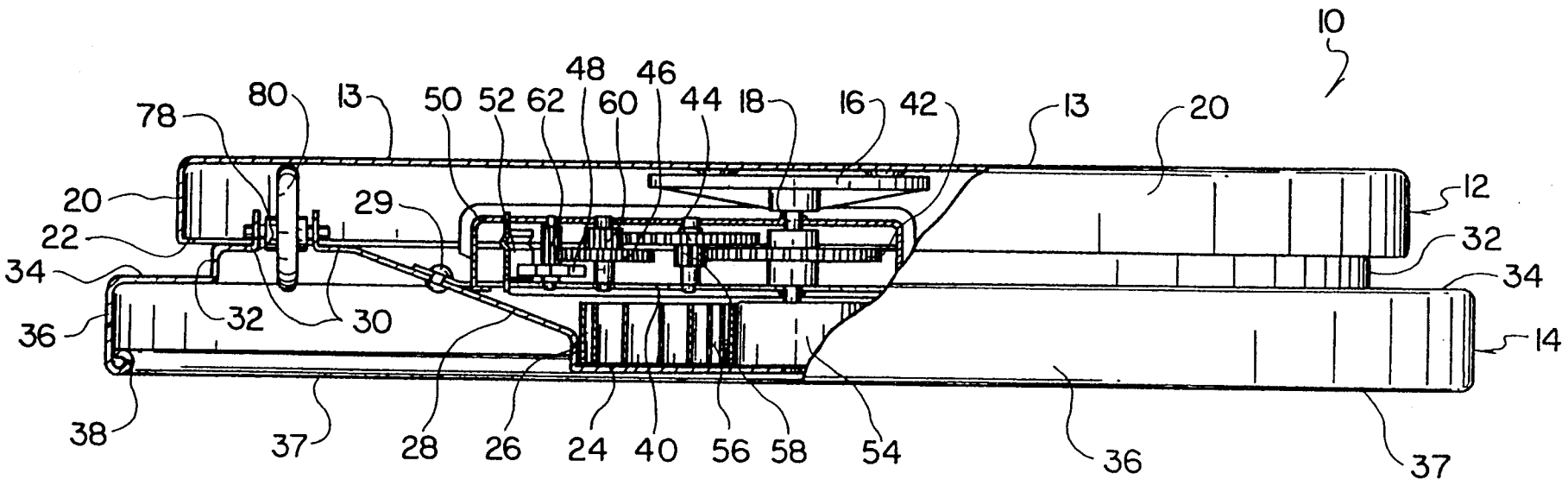
FIG. 3 is a view of FIG. 2 with parts partially broken away to further facilitate illustration of the internal construction thereof.

Referring now to the drawings, and in particular to FIG. 1, there is shown a turntable 10. A turntable top 12 is rotatably supported above a base 14 and is connected to a mounting clip 16, as shown in FIGS. 2 and 3. The mounting clip 16 has a substantially square aperture along its vertical axis so the mounting clip 16 can be connected to a gear shaft 18. The gear shaft 18 further communicates with a gear train assembly which will be more fully described hereinafter.

The turntable top 12 is preferably circular having a circumferential rim 20 extending downwardly and relatively perpendicularly from its upper surface 13. Preferably, the turntable top 12 has a radius of about 4.320 inches and is stamped from 0.030 inch steel. The circumferential rim 20 is preferably about 0.750 inches in length and forms an inwardly curled lip 22. Preferably, the turntable top 12 is concave so that when it is attached to the base 14 its center is lower than its periphery. Alternatively, the turntable top 12 could include an annular recess for preventing containers from working their way off the turntable top 12. The turntable top 12 is preferably coated with a light grey non-stick silicone or Silverstone finish or the like.

The base 14 is preferably a unitary piece stamped from 0.030 inch steel, or any other appropriate sheet metal. Preferably, the base 14 is substantially square along its periphery and has rounded corners. Referring now to FIG. 3, the base 14 has a circular planar bottom portion 24 that preferably has a radius of about 1.5 inches. Extending upwardly from and continuing along the perimeter of the bottom portion 24 is a bottom wall 26 that extends to a point where it flares radially outwardly to form an inclined wall 28. The inclined wall 28 continues until it forms a circumferential raised rim portion 30 which is substantially parallel to the bottom portion 24. The raised rim portion 30 has a lateral wall 32 extending downwardly and relatively perpendicularly therefrom. The lateral wall 32 continues until it connects with the base portion 34 that is substantially parallel to the bottom portion 24. Extending downwardly and perpendicularly from the base portion 34 is a perimetric base rim 36 that includes on its bottom edge a circumferential rolled bead 38. The bead 38 could have an alternate shape such as a flat in-turned lip, for example. The oven turntable 10 rests upon the lower surface 37 formed by the circumferential bead 38. Preferably, the base 14 is coated with silicon or Silverstone finish, but could alternatively be finished with any other suitable material.

With reference to FIG. 1, the inclined wall 28 of the base 14 has formed therein two diametrically opposed apertures to which a gear support 40 is mounted with appropriate rivets 29. The gear support 40 is preferably stamped from 0.030 inch steel.

Referring to FIG. 3, the gear train assembly includes a spring gear 42, a first gear 44, a second gear 46, and a star gear 48, each of which is rotatably mounted between the gear support 40 and a gear housing 50 that is also preferably stamped from 0.030 inch steel. The gears 42, 44, 46, and 48 are preferably made of an appropriate powdered metal capable of withstanding heat of at least 500° Fahrenheit. The gear housing 50 is connected to the gear support 40, in any suitable manner, so that the gears 42, 44, 46, and 48 are rotationally supported therebetween. For example, each gear 44, 46 and 48 can be mounted upon a corresponding axle. Each axle has one end extending into an aperture in the gear support 40 and the opposite end into a corresponding aperture in the gear housing 50 so that the gears are capable of rotationally meshing. Additionally, an escapement blade 52 is pivotally supported between the gear support 40 and the gear housing 50. The escapement blade 52 has one axle portion extending into an aperture in the gear support 40 and a second axle portion extending into a corresponding aperture in the gear housing 50.

A spring arbor 54 is rotationally mounted beneath the gear support 40. The spring arbor 54, spring gear 42, and mounting clip 16 are coaxially fixed upon the spring gear shaft 18 for unified rotation. A flat spiral spring 56 is housed beneath the gear support 40 and inside the bottom wall 26. Preferably, the spring 56 is made of 301 stainless steel and is about 0.012 inches thick. One end of the spring 56 is fastened to the spring arbor 54, in any suitable manner, and the other end of the spring 56 is fastened to a notch in the bottom wall 26. When the spring 56 is tightly wound, the spring gear shaft 18 is urged to rotate about its vertical axis. Counterclockwise rotation of the turntable top 12 winds the spring 56.

The spring gear 42 includes teeth that are in meshing engagement with a pinion 58 associated with the first gear 44. The first gear 44 includes teeth that are in meshing engagement with a pinion 60 associated with the second gear 46. The second gear 46 includes teeth that are in meshing engagement with a pinion 62 associated with the star gear 48. The star gear 48 communicates with a first pawl 64 and a second pawl 66 of the escapement blade 52, as best shown in FIG. 1. The escapement blade 52 has a weight 68 attached to the end of each of its arms 70, 72. The escapement blade 52 ultimately determines the rate of the spring gear's 42 rotation.

Preferably, each gear 42, 44, 46, and 48 has a 48 pitch and a pressure angle of 20°. Preferably, the spring gear 42 has 60 teeth; the first gear 44 has 48 teeth and pinion 58 has 10 teeth; the second gear 46 has 30 teeth and pinion 60 has 10 teeth; and the star gear has 6 teeth and pinion 62 has 6 teeth. Preferably, the gear train assembly, escapement blade 52, and spring 56 will rotate the turntable top 12 for about one hour at approximately one complete turn every 2.5 minutes when the turntable top 12 has a ten pound weight thereon.

With reference to FIG. 1, the first pawl 64 and second pawl 66 mesh with the teeth of the star gear 48 at different points. The first pawl 64 will completely mesh with a tooth of the star gear 48 only when the second pawl 66 is freed from the star gear 48. The second pawl 66 will completely mesh only when the first pawl 64 is freed from the star gear 48. Thus, the escapement blade 52 will oscillate back and forth as the star gear 48 rotates and the permissible speed of gear rotation is determined by the frequency of the escapement blade 52. The weights 68 may be changed to alter the frequency of the escapement blade 52.

The gear housing 50 and the gear support 40 each have an arcuate slot 74 through which an axle 76 slidably extends. The second gear 46 is mounted upon the axle 76. When the spring gear 42 is rotated clockwise the first gear 44 urges the axle 76 to one end of the arcuate slots 74. In this position the second gear 46 meshes with the pinion 62 of the star gear 48. When the spring gear 42 is rotated counterclockwise, i.e., when the spring 56 is being wound, the axle 76 is urged to the opposite end of the arcuate slots 74 whereupon the second gear 46 will not mesh with the star gear 48. This construction prevents the escapement blade 52 from impeding the speed at which the spring 56 can be wound.

Preferably, the raised rim portion 30 has three symmetrically spaced apertures 78 disposed around its circumference. A support wheel 80 is rotationally mounted, in any suitable manner, within each of the apertures 78 so that substantially all of the upper half of each support wheel 80 extends above the raised rim portion 30, as best shown in FIG. 3. Each support wheel 80 has a cross-sectional radius of curvature that defines a point of tangential contact between each support wheel 80 and the underside of the turntable top 12. Preferably, the cross-sectional radius of curvature of each support wheel is a semicircle with the width of each wheel 80 being about 0.10 inches and the diameter being about 1.266 inches. The point contact between each support wheel 80 and the underside of the turntable top 12 ensures that the coefficient of friction between each wheel support 80 and the underside of the turntable top 12 is kept to a minimum.

A detent 82 is slidably mounted to the base 14, in any suitable manner, such as by positioning a slide fit slot 83 of the detent 82 upon a rivet located within the base 14. Preferably, a valley 85 is formed within the inclined wall 28 and the raised rim portion 30 so that the detent 82 rests upon the base portion 34, as best shown in FIG. 1. The detent 82 has a retaining tongue 84 connected to its underside that is adapted to engage with a first retaining groove 86 and a second retaining groove 88 formed within the base 14, as best shown in FIG. 2. The detent 82 has a handle 90 for sliding the detent 82 forward and backward. When the detent 82 is in its forward position a contact portion 92 of the detent 82 engages the escapement blade 52 and urges it forward until the pawl 64 becomes meshed with a tooth of the star gear 48 thereby precluding movement of the escapement blade 52 and rotation of the turntable top 12. The tongue 84 rests within the first retaining groove 86 in the forward position so that movement of the detent 82 is prohibited. When the detent 82 is slid to its rearward position the turntable top 12 can rotate freely and the tongue 84 rests within the second groove 88 so that movement of the detent 82 is restricted. Preferably, the detent 82 is colored red with high temperature oven proof paint.

Preferably, all parts of the preferred embodiment of the present invention are capable of withstanding at least 500° Fahrenheit.

Although the preferred embodiment of this invention has been shown and described, it should be understood that various modifications and rearrangements of the parts may be resorted to without departing from the scope of the invention as disclosed and claimed herein.

What I claim is:

1. A rotatable platform, comprising a base having a raised rim portion, said raised rim portion including a plurality of apertures;

a turntable top rotatably disposed above said base;

means for rotating said turntable top disposed within said base;

means for governing the rotational speed of said turntable top, said governing means cooperates with said rotating means; and means for supporting the periphery of said turntable top above said base, said supporting means being carried by said raised rim portion and including a plurality of support wheels, each of said support wheels being rotationally disposed within one of said raised rim portion apertures.

2. A rotatable platform as recited in claim 1, further comprising;

means for braking the rotation of said turntable top.

3. A rotatable platform as recited in claim 2, wherein;

said braking means includes a detent movably mounted upon said base, said detent being movable between an engaged position wherein a portion of said detent engages said governing means and urges it against said rotating means to prevent said turntable top from rotating, and a disengaged position.

4. A rotatable platform as recited in claim 3, wherein;

said detent includes a tongue that rests within a first groove formed within said base when said detent is in said engaged position so that said detent is retained in said engaged position, said tongue resting within a second groove formed within said base when said detent is in said disengaged position so that said detent is retained in said disengaged position.

5. A rotatable platform as recited in claim 3, wherein;

said base includes a bottom portion upon which a biasing means is supported, a bottom wall extending from said bottom portion for containing said biasing means, an inclined wall extending radially from said bottom wall to said raised rim portion, and a lateral wall for preventing food particles from contacting the interior of said base, said lateral wall connecting a relatively square base portion to said raised rim portion.

6. A rotatable platform as recited in claim 5, wherein;

said base is stamped from about 0.030 inch thick steel.

7. A rotatable platform as recited in claim 3, wherein;

said turntable top defines a relatively concave surface.

8. A rotatable platform as recited in claim 5, wherein;

said rotatable platform is made of material capable of withstanding a temperature of at least 500° Fahrenheit.

9. A rotatable platform as recited in claim 5, wherein;

a base rim extends from said base portion for supporting said rotatable platform, said base rim having an inwardly turned circumferential bead for preventing accumulation of food particles thereon.

10. A rotatable platform as recited in claim 2, wherein;

each of said support wheels includes a cross-sectional radius of curvature that defines a tangential point of contact, each of said points of contact engages the underside of said turntable top for supporting said turntable top.

11. A rotatable platform as recited in claim 10, wherein;

each of said support wheels includes a semicircular radius of curvature when each of said support wheels has a width of about 0.10 inch and a diameter of about 1.266 inches.

12. A rotatable platform as recited in claim 1, wherein;

said turntable top includes a circumferential rim for concealing said raised rim portion, said circumferential rim including an edge portion that extends inwardly toward the center of said turntable top thereby forming an inwardly extending horizontal lip to prevent the accumulation of food stuffs thereon.

13. A rotatable platform as recited in claim 1, wherein;

each of said support wheels has a cross-sectional radius of curvature defining a tangential point of contact with the underside of said turntable top thereby supporting said turntable top.

14. A rotatable platform as recited in claim 13, wherein;

each of said support wheels has a semicircular radius of curvature when each of said support wheels has a width of about 0.10 inch and a diameter of about 1.266 inches.

15. A rotatable platform as recited in claim 13, wherein;

said support wheels are symmetrically disposed around said raised rim portion.

16. A rotatable platform as recited in claim 1, wherein;

said rotating means includes a gear train assembly disposed within said base, a biasing means for rotating a spring gear of said gear train assembly, said spring gear being operatively joined to said turntable top whereby when said biasing means rotates said spring gear said turntable top is rotated by said spring gear.

17. A rotatable platform as recited in claim 16, wherein;

said gear train assembly further includes a first gear having a pinion that is meshingly engaged with said spring gear, a second gear having a pinion that is meshingly engaged with said first gear, and a star gear having a pinion that is meshingly engageable with said second gear, said star gear being positioned to cooperate with said means for governing the rotational speed of said turntable top.

18. A rotatable platform as recited in claim 17, wherein;

said second gear is movable between a first position and a second position, when said second gear is in said first position said pinion of said second gear meshingly engages said pinion of said star gear for rotation of said turntable top, when said second gear is in said second position said pinion of said second gear is disengaged from said pinion of said star gear so that said governing means does not interfere with the counterclockwise rotation of said turntable top when winding said biasing means.

19. A rotatable platform as recited in claim 17, wherein;

each of said gears has a 48 pitch and a pressure angle of about 20°.

20. A rotatable platform as recited in claim 16, wherein;

said means for governing the rotational speed of said turntable top includes an escapement blade pivotally mounted within said base, said escapement blade includes a first arm and second arm each having a free end, and a first pawl and a second pawl, each of said pawls being engageable with said gear train assembly.

21. A rotatable platform as recited in claim 20, wherein;

a weight is connected to the free end of each of said arms.

22. A rotatable platform as recited in claim 16, wherein;

said biasing means is a flat spiral spring made of 301 stainless steel having a thickness of about 0.012 inch.

* * * * *